US011473876B2

(12) United States Patent
Landtiser

(10) Patent No.: US 11,473,876 B2
(45) Date of Patent: Oct. 18, 2022

(54) BULLET-RESISTIVE INSERT ASSEMBLY FOR A BACKPACK AND THE LIKE

(71) Applicant: Kerry L. Landtiser, Elgin, IL (US)

(72) Inventor: Kerry L. Landtiser, Elgin, IL (US)

(73) Assignee: World Richman Manufacturing Corporation, Elgin, IL (US)

( * ) Notice: Subject to any disclaimer, the term of this patent is extended or adjusted under 35 U.S.C. 154(b) by 450 days.

(21) Appl. No.: 16/660,693

(22) Filed: Oct. 22, 2019

(65) Prior Publication Data

US 2020/0124384 A1 Apr. 23, 2020

Related U.S. Application Data

(60) Provisional application No. 62/749,630, filed on Oct. 23, 2018.

(51) Int. Cl.

| | |
|---|---|
| ***F41H 5/04*** | (2006.01) |
| ***F41H 1/02*** | (2006.01) |
| ***F41H 5/08*** | (2006.01) |
| *A45F 3/04* | (2006.01) |
| *A45F 3/00* | (2006.01) |

(52) U.S. Cl.

CPC ..... *F41H 1/02* (2013.01); *F41H 5/04* (2013.01); *F41H 5/08* (2013.01); *A45F 3/04* (2013.01); *A45F 2003/001* (2013.01)

(58) Field of Classification Search

CPC ..... F41H 5/04; F41H 1/02; F41H 5/08

See application file for complete search history.

(56) References Cited

U.S. PATENT DOCUMENTS

| | | | | |
|---|---|---|---|---|
| 2015/0323289 | A1* | 11/2015 | Seuk | F41H 1/02 89/36.05 |
| 2020/0025526 | A1* | 1/2020 | Seuk | F41H 5/02 |
| 2020/0333111 | A1* | 10/2020 | Ward | F41H 1/02 |
| 2021/0212426 | A1* | 7/2021 | Huang | A45C 9/00 |

* cited by examiner

*Primary Examiner* — J. Woodrow Eldred

(74) *Attorney, Agent, or Firm* — Christopher J. Scott

(57) ABSTRACT

A bullet-resistive or projectile-resistive insert assembly includes at least one anti-ballistic material sheet formed peripherally for receipt in a sheet-covering envelope. An exterior sheet-covering envelope assembly envelops or covers the anti-ballistic material sheet or sheets and includes anterior and posterior envelope material layers. The anterior and posterior envelope material layers are respectively received in anterior and posterior relation relative to the anti-ballistic material thereby sandwiching the same intermediate the enveloping material layers. The anti-ballistic material comprises an outer peripheral stack contour formed to match and mate with an inner peripheral envelope contour of the exterior sheet-covering envelope assembly. The anti-ballistic material includes an anterior stack section, a central stack section, and a posterior stack section. The central stack section has a central stack top-to-bottom length relatively greater in magnitude than an anterior stack top-to-bottom length and a posterior stack top-to-bottom length respectively associated with the anterior and posterior stack sections.

17 Claims, 10 Drawing Sheets

BULLET-RESISTIVE INSERT ASSEMBLY FOR A BACKPACK AND THE LIKE

PRIOR HISTORY

This application claims the benefit of U.S. Provisional Patent Application No. 62/749,630 filed in the United States Patent and Trademark Office (USPTO) on 23 Oct. 2018, the specifications and drawings of which are hereby incorporated by reference thereto.

BACKGROUND OF THE INVENTION

Field of the Invention

The present invention relates generally to an assembly dimensioned for insertion into primary article-carrying packs exemplified by backpacks or luggage for providing an anti-ballistic function to the primary article-carrying packs. The present invention more particularly relates to a bullet-resistive or projectile-resistive insert assembly co-operable with packs carried and/or worn by users so as to provide an anti-ballistic function via the pack-insert assembly combination for protecting the user carrying the pack-insert assembly combination.

SUMMARY OF THE INVENTION

Among the many objectives of this invention is the provision of a bullet-resistive or projectile-resistive insert assembly for removable insertion into a backpack or similar other article-carrying pack. The projectile-resistive insert assembly according to the present invention essentially comprises at least one anti-ballistic material sheet and a sheet-covering envelope assembly.

The at least one material sheet preferably comprises or consists of an anti-ballistic, projectile-resistive material, and is formed peripherally for receipt in a sheet-covering envelope. The exterior sheet-covering envelope assembly according to the present invention essentially comprises an anterior envelope material layer and a posterior envelope material layer.

The anterior envelope material layer and the posterior envelope material layer are respectively received in anterior and posterior relation relative to the at least one material sheet thereby sandwiching the at least one material sheet between the anterior envelope material layer and the posterior envelope material layer. The anterior envelope material layer is attached to the posterior envelope material layer for enveloping the at least one material sheet. The resulting projectile-resistive insert assembly is insertable into a pack for resisting projectile penetration through material planes of the pack exemplified by a backpack.

The at least one material sheet may be sandwiched intermediate the anterior and posterior envelope material layers in a multi-sheet stack, each of which comprise a select projectile-resistive material. A series of pocket formations may be formed or positioned in anterior adjacency to the anterior envelope material layer for enabling the user to pocket-receive storable articles. A select envelope material layer as selected from the anterior and posterior envelope material layers may preferably comprise certain means (e.g. a zipper mechanism) for enabling the user to access the at least one material sheet or the multi-sheet stack of material sheets as necessary.

A handle formation may be preferably attached in adjacency to a top assembly edge and the posterior envelope material layer for enhancing the user's ability to carry the bullet-resistive insert assembly. The bottom assembly edge is preferably linear and extends in a bottom edge plane and laterally opposed assembly edges extend obliquely relative to the bottom edge plane. The at least one material sheet or multi-layered stack of material sheets or multi-sheet stack comprises an outer peripheral stack contour. The outer peripheral stack contour is preferably formed to mate with an inner peripheral envelope contour of the exterior sheet-covering envelope assembly.

The multi-layered stack of material sheets may preferably comprise an anterior stack section, a central stack section, and a posterior stack section. The central stack section may preferably have a central stack top-to-bottom length relatively greater in magnitude or length than an anterior stack top-to-bottom length and a posterior stack top-to-bottom length. The central stack section may preferably further comprise a top central stack section and a bottom central stack section, wherein the top central stack section and the bottom central stack section are arcuate in anterior-to-posterior cross-section.

The central stack section may further preferably comprise an anterior-most material layer and a posterior-most material layer. The anterior-most material layer extends in an anterior material plane and the posterior-most material layer extends in a posterior material plane parallel to the anterior material plane. The anterior stack section and the posterior stack section are each obliquely angled relative to the anterior material plane and posterior material plane at anterior and posterior angled portions where the anterior stack section and the posterior stack section respectively meet the anterior-most material layer and the posterior-most material layer.

BRIEF DESCRIPTIONS OF THE DRAWINGS

Other features and objectives of the invention will become more evident from a consideration of the following brief descriptions of patent drawings.

DETAILED DESCRIPTION OF THE PREFERRED EMBODIMENT

Figure 1:
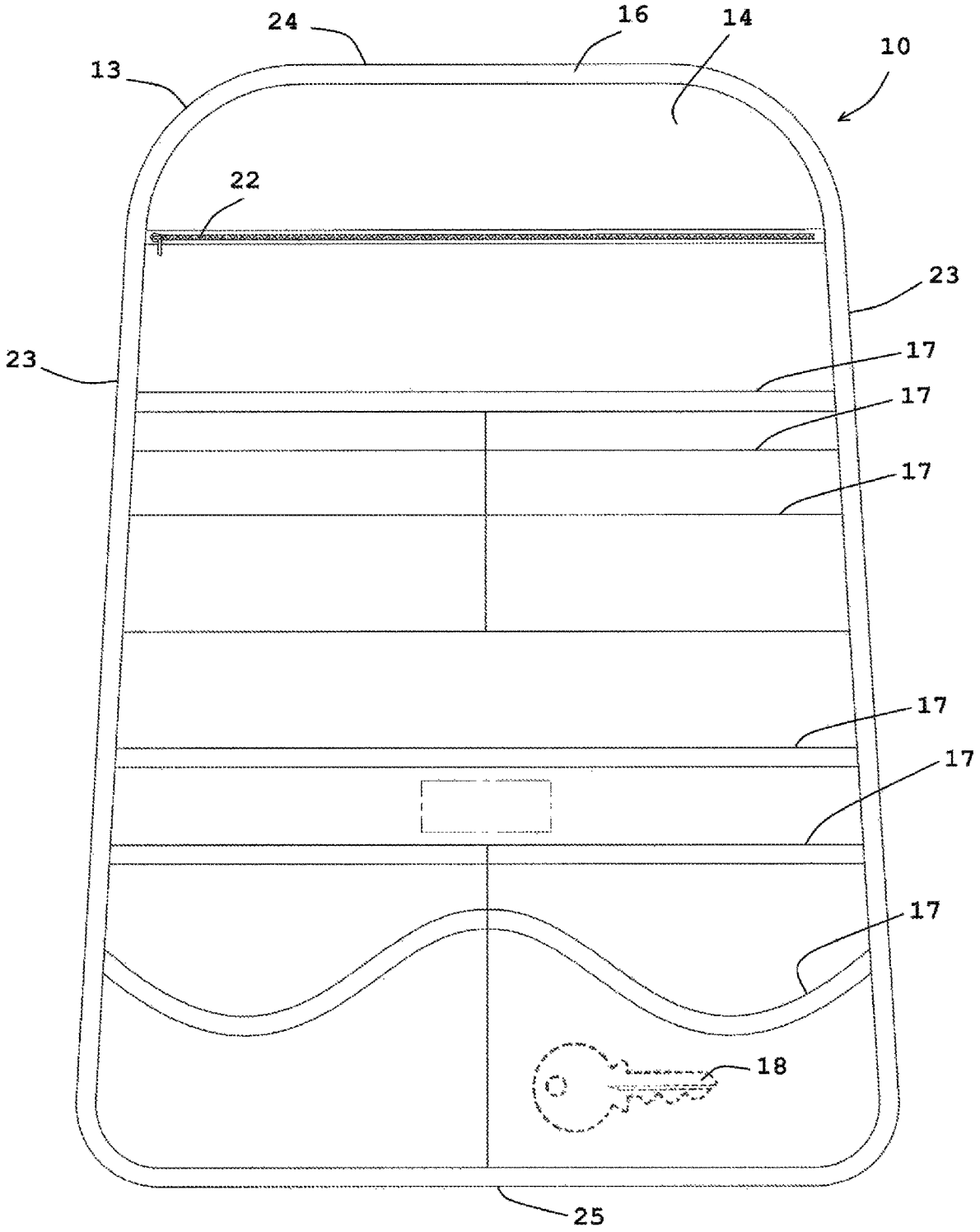
FIG. 1 is a first anterior plan view of the bullet-resistive or projectile-resistive insert assembly according to the present invention.

Referring now to the drawings with more specificity, the following specifications generally describe a bulletproof or bullet-resistive or projectile-resistive insert assembly 10 for insertion inside a backpack or the like. The bullet-resistive or projectile-resistive insert assembly 10 according to the present invention preferably comprises at least one material sheet 12, but preferably a multi-layered stack 11 of material sheets 12 and an exterior sheet-covering envelope assembly as at 13.

The material sheets of the at least one material sheet 12 or multi-layered stack 11 of material sheets 12 each preferably comprise a select bullet-resistive or projective-resistive material or ballistic or anti-ballistic material exemplified by KEVLAR; LEXAN; Ultra-High-Molecular-Weight Polyethylene (UHMWP); or carbon fiber composite materials. The present invention contemplates at least one anti ballistic material sheet 12 as selected from any such suitable material, but preferably a stack 11 of anti-ballistic material sheets 12 comprising either a uniform anti-ballistic material or any combination of sheets comprising select anti-ballistic materials.

The at least one material sheet 12 or multi-layered stack 11 of material sheets 12 are further preferably formed peripherally for receipt in a stack-covering envelope exemplified by exterior sheet-covering envelope assembly 13. The exterior sheet-covering envelope assembly 13 preferably comprises an anterior envelope material layer as at 14, a posterior envelope material layer as at 15, and a peripheral edge binding or piping element or cover as at 16.

The anterior envelope material layer 14 and the posterior envelope material layer 15 are respectively received in anterior and posterior stacked relation relative to the at least one material sheet 12 or multi-layered stack 11 of material sheets 12 thereby sandwiching the at least one material sheet 12 or multi-layered stack 11 of material sheets 12 between the anterior envelope material layer 14 and the posterior envelope material layer 15.

Figure 11:
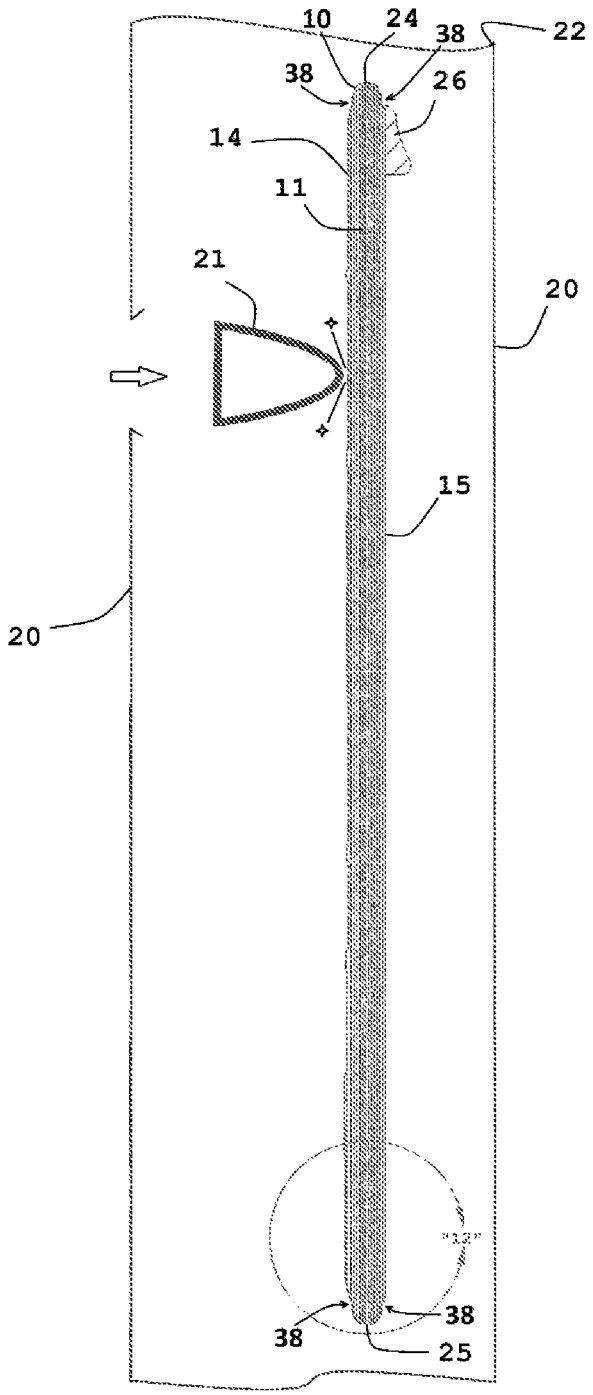
FIG. 11 is a longitudinal cross-sectional view of the bullet-resistive or projectile-resistive insert assembly according to the present invention diagrammatically depicting the bullet-resistive or projectile-resistive insert assembly inserted inside a generic and fragmentary backpack construction to depict projectile-resisting functionality according to the present invention.

The anterior envelope material layer 14 is preferably attached to the posterior envelope material layer 15 for enveloping the at least one material sheet 12 or multi-layered stack 11 of material sheets 12. Preferably, the peripheral edge binding 16 covers outer edging of the anterior envelope material layer 14 and the posterior envelope material layer 15 thereby binding the anterior envelope material layer 14 to the posterior envelope material layer 15 and providing a finished look for the bullet-resistive or projectile-resistive insert assembly 10 then insertable into a backpack or similar other article-carrying pack for resisting penetration of a bullet 21 or similar other projectile through at least one material layer 20 of the backpack 22 as generally depicted in FIG. 11.

The bullet-resistive or projectile-resistive insert assembly 10 according to the present invention may further preferably comprise at least, but preferably a series of pocket formations as variously depicted and referenced at 17. The pocket formations 17 are preferably positioned in anterior adjacency to the anterior envelope material layer 14 for enabling the user to pocket-receive storable articles as exemplified by a key 18 as received in a bottom-most pocket formation 17 of the bullet-resistive or projectile-resistive insert assembly 10 as generally depicted and referenced in FIG. 1.

The anterior envelope material layer 14 or posterior envelope material layer 15 may further preferably comprise certain means for enabling the user to access the at least one or multi-layered stack 11 of material sheets 12 as exemplified by a zipper mechanism 22 preferably extending widthwise intermediate laterally opposed assembly edges 23 of the bullet-resistive or projectile-resistive insert assembly 10. The zipper mechanism 22 is illustrated in the drawings submitted in support of these specifications as being formed in the anterior envelope material layer 14 as an exemplary placement of the zipper mechanism 22.

The bullet-resistive or projectile-resistive insert assembly 10 according to the present invention further preferably comprises a top assembly edge as at 24, and a bottom assembly edge as at 25. The bullet-resistive or projectile-resistive insert assembly 10 according to the present invention may further comprise a handle formation as at 26 attached in adjacency to the top assembly edge 24 and posterior envelope material layer 15 for enhancing the user's ability to carry the bullet-resistive insert assembly 10. The handle formation 26 is illustrated in the drawings submitted in support of these specifications as being formed adjacent the posterior envelope material layer 15 as an exemplary placement of the handle formation 26.

Figure 2:
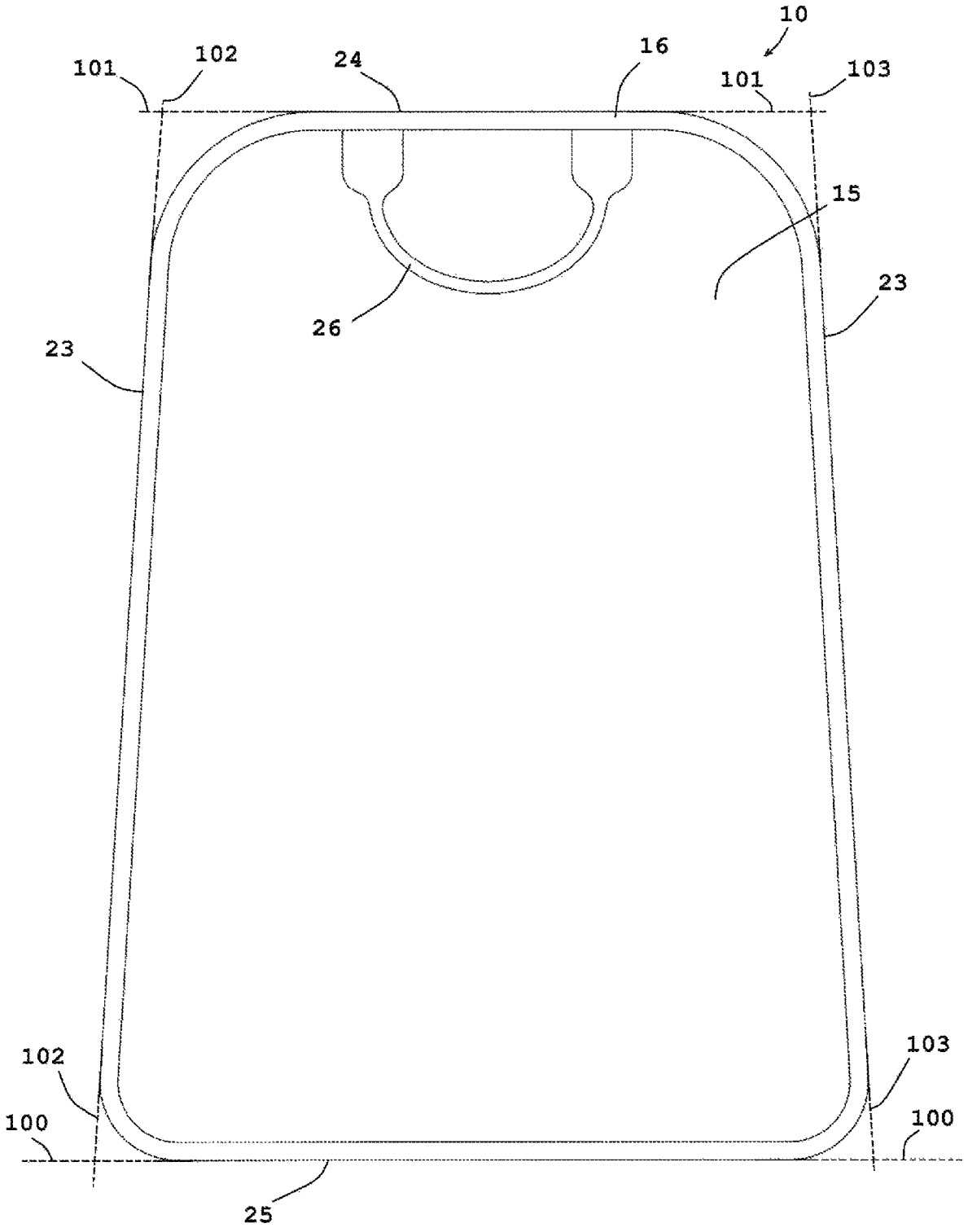
FIG. 2 is a posterior plan view of the bullet-resistive or projectile-resistive insert assembly according to the present invention.
Figure 3:
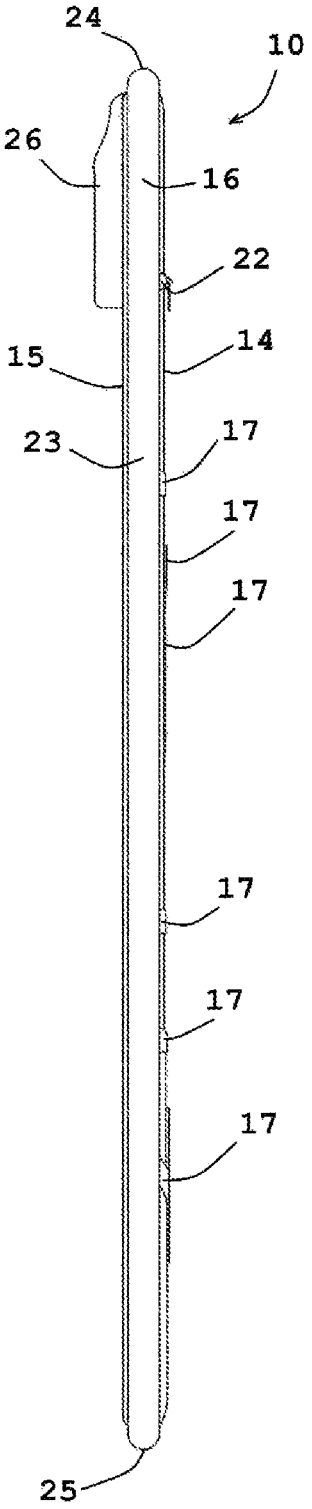
FIG. 3 is a first lateral edge view of a first lateral assembly edge of the bullet-resistive or projectile-resistive insert assembly according to the present invention.
Figure 4:
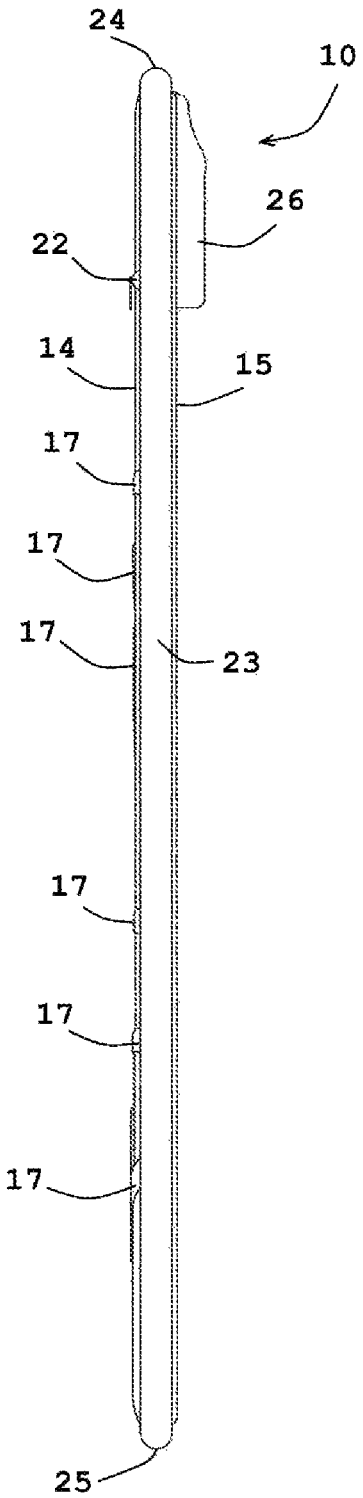
FIG. 4 is a second lateral edge view of a second lateral assembly edge of the bullet-resistive or projectile-resistive insert assembly according to the present invention.
Figure 5:
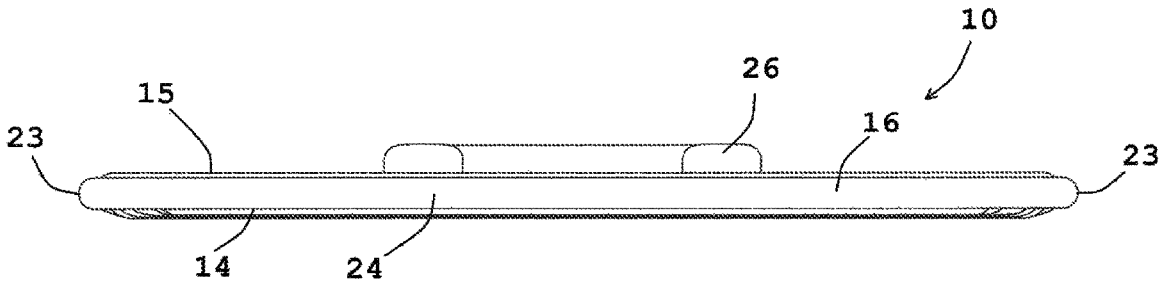
FIG. 5 is a top edge view of the bullet-resistive or projectile-resistive insert assembly according to the present invention.
Figure 6:
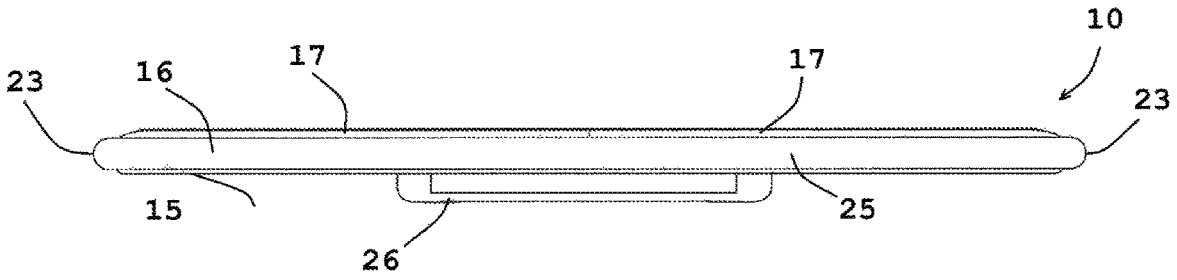
FIG. 6 is a bottom edge view of the bullet-resistive or projectile-resistive insert assembly according to the present invention.
Figure 7:
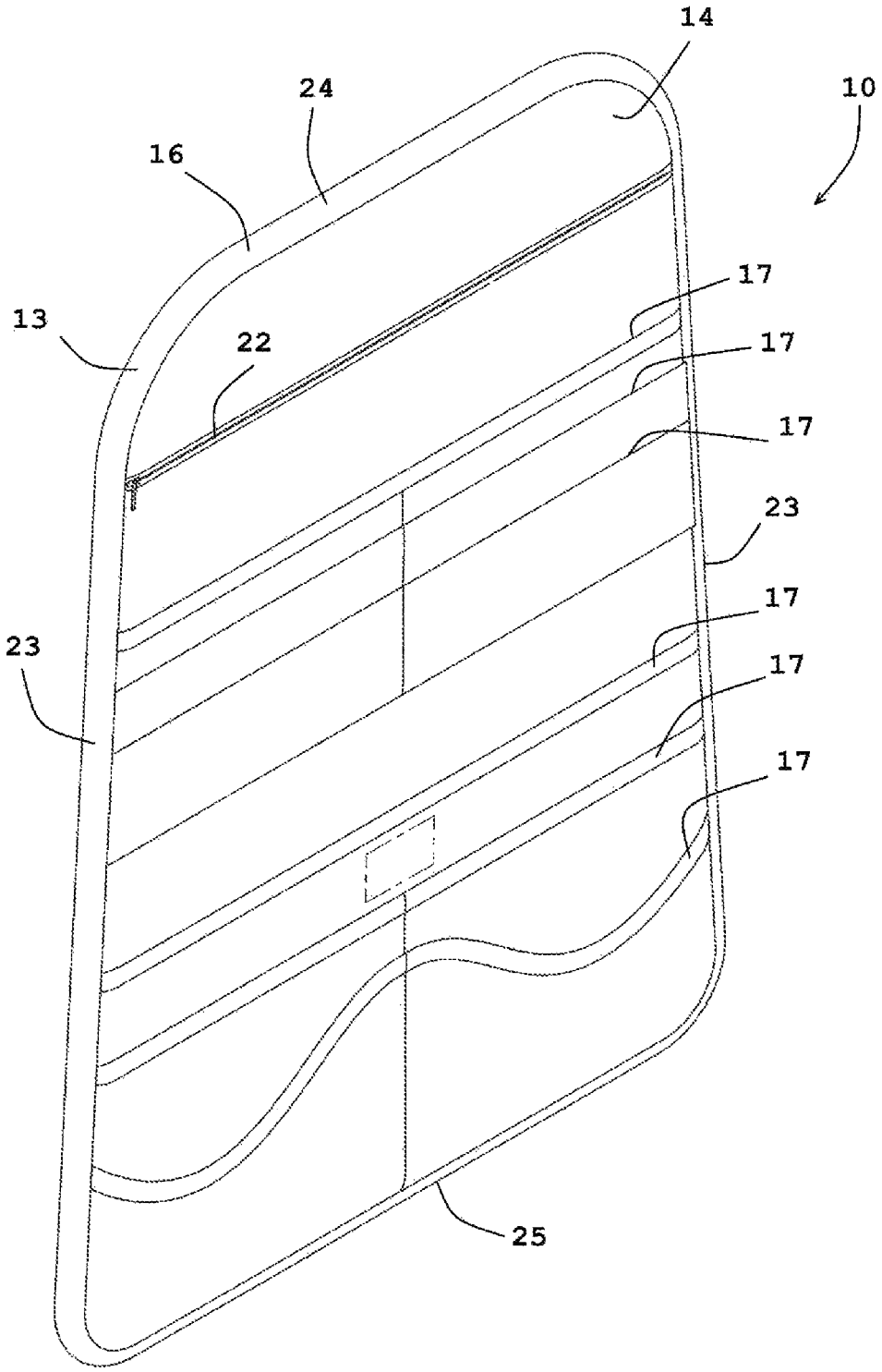
FIG. 7 is a top anterior perspective view of the bullet-resistive or projectile-resistive insert assembly according to the present invention.
Figure 8:
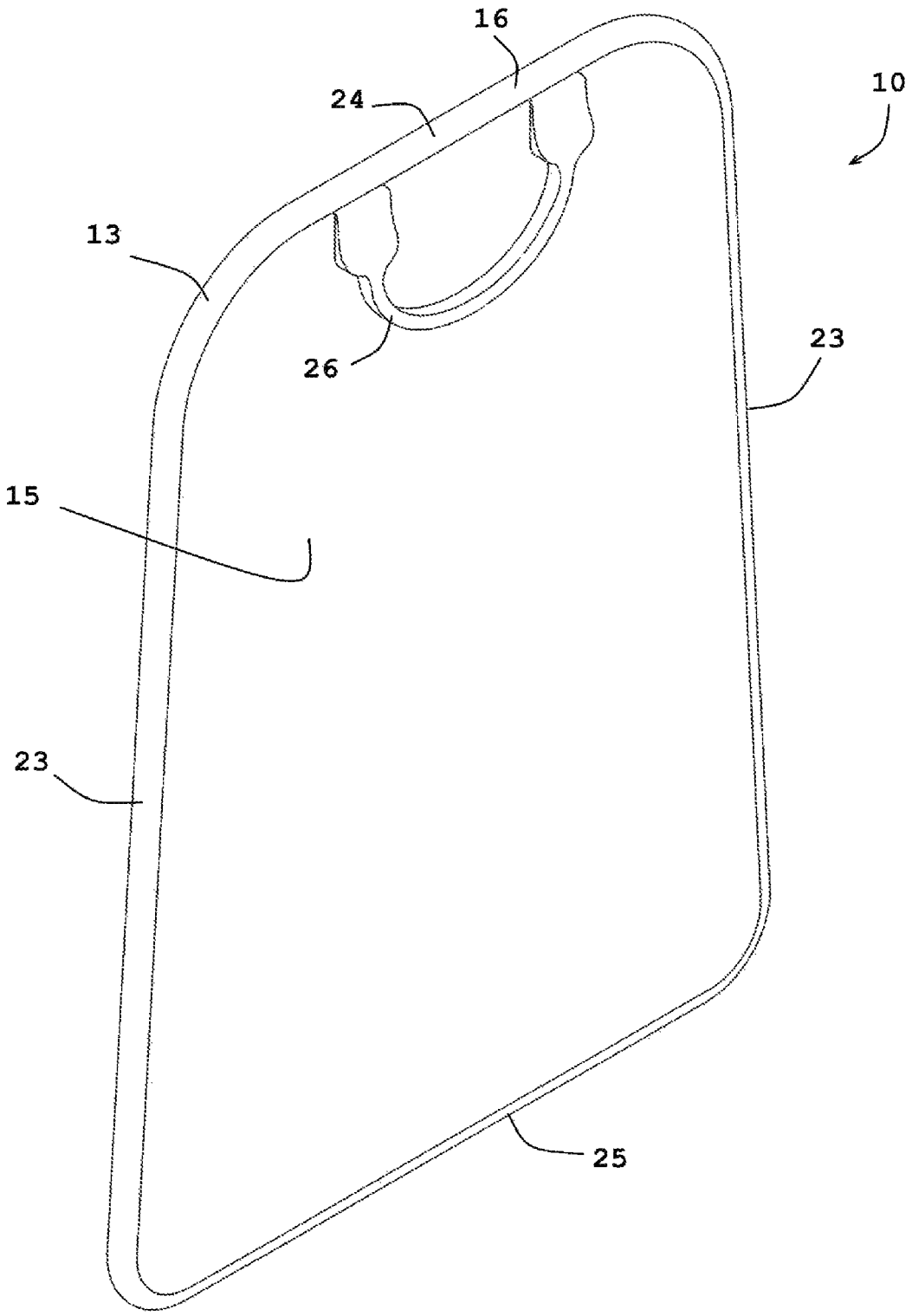
FIG. 8 is a top posterior perspective view of the bullet-resistive or projectile-resistive insert assembly according to the present invention.
Figures 9, 9A:
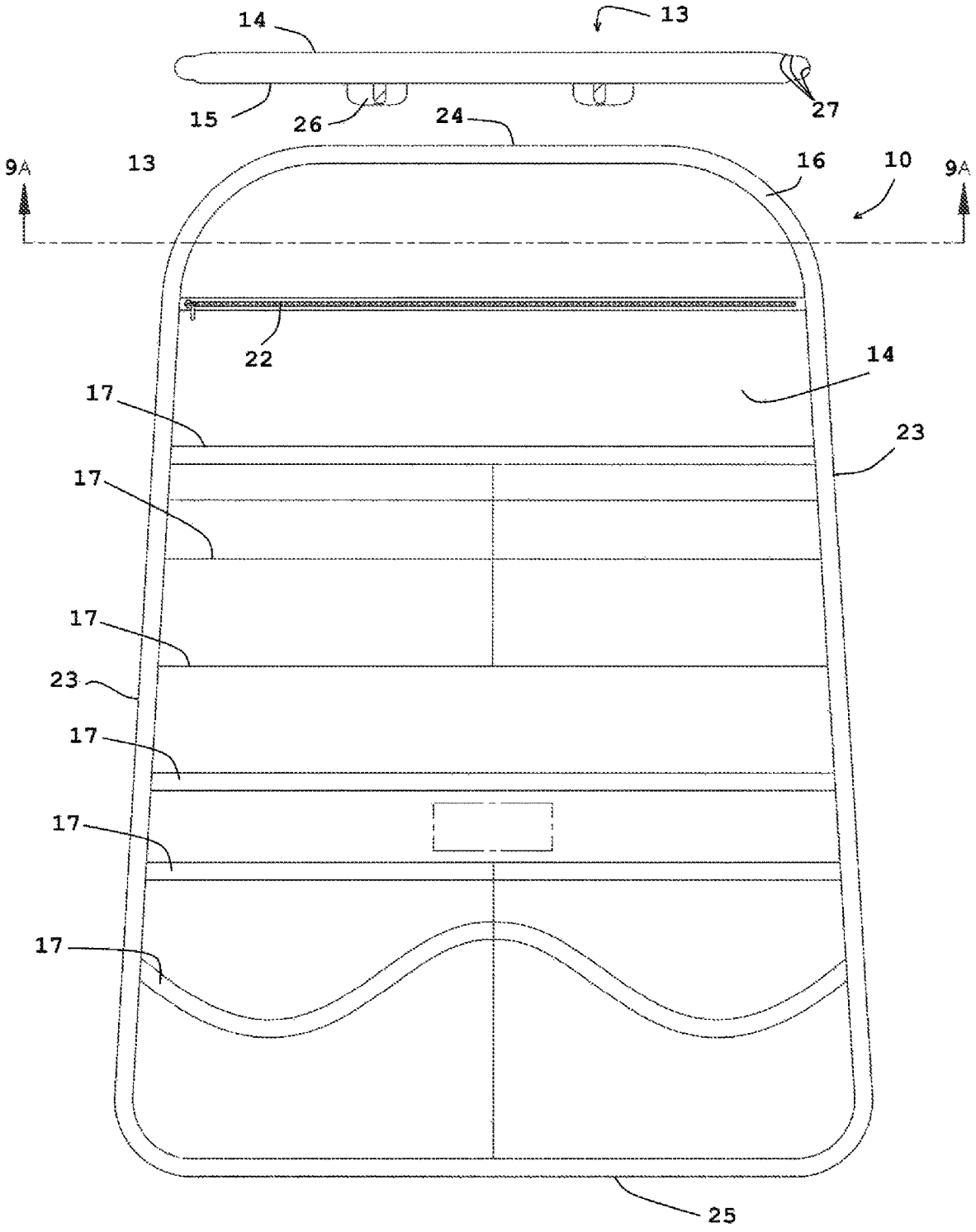
FIG. 9 is a second anterior plan view of the bullet-resistive or projectile-resistive insert assembly according to the present invention.
FIG. 9A is a latitudinal cross-sectional view of the bullet-resistive or projectile-resistive insert assembly according to the present invention as sectioned from FIG. 9.
Figures 10, 10A:
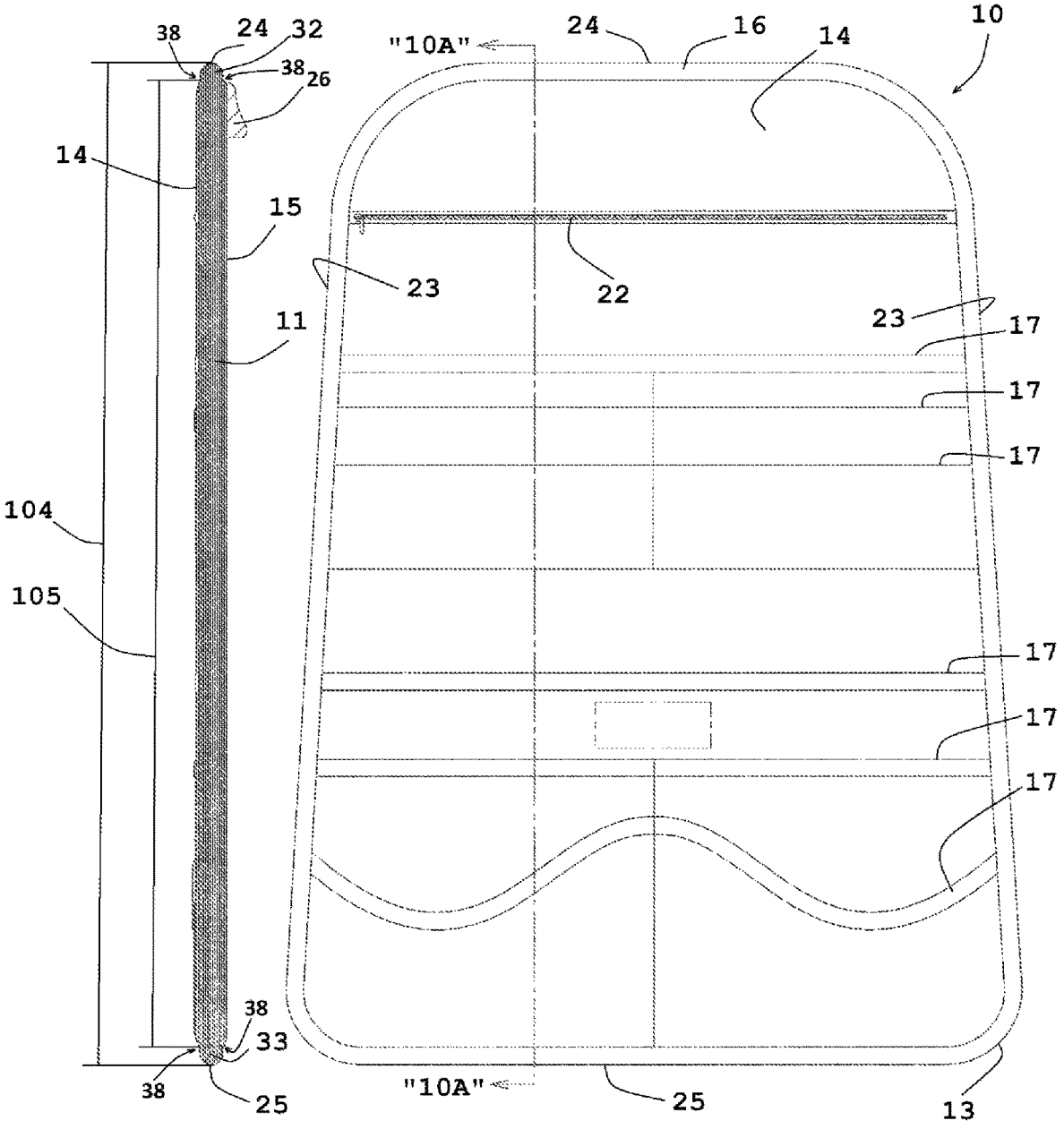
FIG. 10 is a third anterior plan view of the bullet-resistive or projectile-resistive insert assembly according to the present invention.
FIG. 10A is a first longitudinal cross-sectional view of the bullet-resistive or projectile-resistive insert assembly according to the present invention as sectioned from FIG. 10.

The bottom assembly edge 25 preferably extends in a bottom edge plane as at 100, and the top assembly edge 24 preferably extends in a top edge plane as at 101. The laterally opposed assembly edges 23 preferably extend obliquely relative to the bottom edge and top edge planes 100 and 101 in lateral assembly edge planes 102 and 103 as generally depicted and referenced in FIG. 2. Referencing FIGS. 9A and 12, the reader will there consider an inner peripheral envelope contour as at 27 as in FIG. 9A. The at least one material sheet 12 or multi-layered stack 11 of material sheets 12 preferably comprises an outer peripheral stack contour as at 28, which outer peripheral stack contour 28 is formed to match and mate with the inner peripheral envelope contour as at 27.

Figure 12:
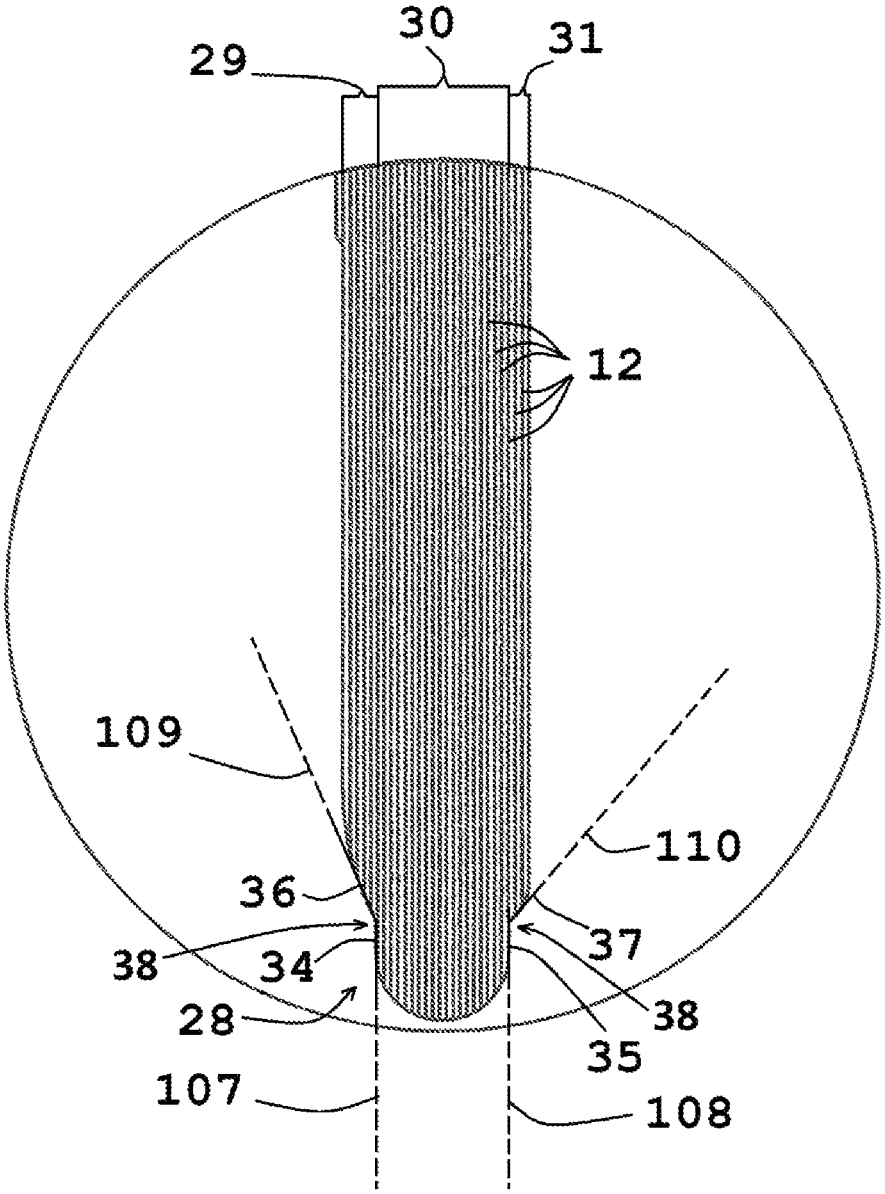
FIG. 12 is an enlarged, fragmentary sectional view of lower portions of the bullet-resistive or projectile-resistive insert assembly as enlarged and sectioned from FIG. 12 to depict in greater clarity a multi-layered stack of material sheets and uniquely configured bottom assembly edge contours of the multi-layered stack of material sheets.

More particularly in this last regard, the at least one material sheet 12 or multi-layered stack 11 of material sheets 12 preferably comprises an anterior stack section as at 29, a central stack section as at 30, and a posterior stack section as at 31 as depicted and referenced in FIG. 12. The central stack section 30 has a central stack top-to-bottom length as at 104 relatively greater in magnitude than an anterior stack top-to-bottom length as at 105 substantially equal to a posterior stack top-to-bottom length (105). The anterior and posterior stack sections 29 and 31 are abbreviated in length relative to the central stack section 30 thereby providing step sections 38 adjacent a top central stack section as at 32 and adjacent a bottom central stack section as at 33.

In other words, the central stack or sheet section 30 preferably comprises the top central stack section 32 and the bottom central stack section 33 stepped at step sections 38 from the anterior and posterior stack or sheet sections 29 and 31. The top central stack section 32 and the bottom central stack section 33 are substantially similar to one another and are further preferably arcuate in anterior-to-posterior cross-section as generally depicted in FIG. 12. The central stack section 30 further preferably comprises an anterior-most material layer as at 34 and a posterior-most material layer as at 35.

The anterior-most material layer 34 extends in an anterior material plane as at 107, and the posterior-most material layer extends in a posterior material plane 108 parallel to the anterior material plane 107. The anterior stack section 29 and the posterior stack section 31 are each preferably obliquely angled as at angled portions 36 and 37, respectively. The angled portion 36 at anterior stack section 29 extends in an anterior section plane 109 and the angled portion 37 at posterior stack section 31 extends in a posterior section plane 110. The anterior and posterior section planes 109 and 110 extend obliquely relative to the anterior material plane 107 and posterior material plane 108 at outer angled portions 36 and 37 where the anterior stack section 29 and the posterior stack section 31 respectively meet the anterior-most material layer 34 and the posterior-most material layer 35.

While the above descriptions contain much specificity, this specificity should not be construed as limitations on the scope of the invention, but rather as an exemplification of the invention. In certain embodiments, the basic invention may be said to essentially teach or disclose a bullet-resistive or projectile-resistive insert assembly for removable insertion into a backpack or similar other article-carrying pack. The projectile-resistive insert assembly according to the present invention essentially comprises at least one material sheet and a sheet-covering envelope assembly.

The at least one material sheet preferably comprises or consists of an anti-ballistic, projectile-resistive material, and is formed peripherally for receipt in a sheet-covering envelope. The exterior sheet-covering envelope assembly according to the present invention essentially comprises an anterior envelope material layer and a posterior envelope material layer.

The anterior envelope material layer and the posterior envelope material layer are respectively received in anterior and posterior relation relative to the at least one material sheet thereby sandwiching the at least one material sheet between the anterior envelope material layer and the posterior envelope material layer. The anterior envelope material layer is attached to the posterior envelope material layer for enveloping the at least one material sheet. The resulting projectile-resistive insert assembly is insertable into a pack for resisting projectile penetration through material planes of the pack exemplified by a backpack.

The at least one material sheet may be sandwiched intermediate the anterior and posterior envelope material layers in a multi-sheet stack, each of which comprise a select projectile-resistive material. A series of pocket formations may be formed or positioned in anterior adjacency to the anterior envelope material layer for enabling the user to pocket-receive storable articles. A select envelope material layer as selected from the anterior and posterior envelope material layers may preferably comprise certain means for enabling the user to access the at least one material sheet or the multi-sheet stack of material sheets as necessary.

A handle formation may be attached in adjacency to top assembly edge preferably and the posterior envelope material layer for enhancing the user's ability to carry the bullet-resistive insert assembly. The bottom assembly edge is preferably linear and extends in a bottom edge plane and laterally opposed assembly edges extend obliquely relative to the bottom edge plane. The at least one material sheet or multi-layered stack of material sheets or multi-sheet stack comprises an outer peripheral stack contour. The outer peripheral stack contour is preferably formed to mate with an inner peripheral envelope contour of the exterior sheet-covering envelope assembly.

The multi-layered stack of material sheets may preferably comprise an anterior stack section, a central stack section, and a posterior stack section. The central stack section may preferably have a central stack top-to-bottom length relatively greater in magnitude or length than an anterior stack top-to-bottom length and a posterior stack top-to-bottom length. The central stack section may preferably further comprise a top central stack section and a bottom central stack section, wherein the top central stack section and the bottom central stack section are arcuate in anterior-to-posterior cross-section.

The central stack section may further preferably comprise an anterior-most material layer and a posterior-most material layer. The anterior-most material layer extends in an anterior material plane and the posterior-most material layer extends in a posterior material plane parallel to the anterior material plane. The anterior stack section and the posterior stack section are each obliquely angled relative to the anterior material plane and posterior material plane at anterior and posterior angled portions where the anterior stack section and the posterior stack section respectively meet the anterior-most material layer and the posterior-most material layer.

Although the bullet-resistive or projectile-resistive insert assembly according to the present invention has been described by reference to a number of different embodiments, aspects, and features, it is not intended that the novel assembly be limited thereby, but that modifications thereof are intended to be included as falling within the broad scope and spirit of the foregoing disclosure, the appended drawings, and the following claims.

What is claimed is:

1. A bullet-resistive insert assembly for a pack, the bullet-resistive insert assembly comprising:

a multi-layered stack of material sheets, the multi-layered stack of material sheets comprising a bullet-resistive material, the multi-layered stack of material sheets being formed peripherally for receipt in a material-covering envelope; and an exterior stack-covering envelope assembly, the exterior stack-covering envelope assembly comprising an anterior envelope material layer and a posterior envelope material layer, the anterior envelope material layer and the posterior envelope material layer being respectively received in anterior and posterior stacked relation relative to the multi-layered stack of material sheets thereby sandwiching the multi-layered stack of material sheets between the anterior envelope material layer and the posterior envelope material layer, the anterior envelope material layer being attached to the posterior envelope material layer for enveloping the multi-layered stack of material sheets;

the multi-layered stack of material sheets comprising an anterior stack section, a central stack section, and a posterior stack section, the anterior stack section having an anterior stack top-to-bottom length, the central stack section having a central stack top-to-bottom length, and the posterior stack section having a posterior stack top-to-bottom length, the central stack top-to-bottom length being greater in magnitude than the anterior stack top-to-bottom length and the posterior stack top-to-bottom length thereby forming step sections at a top portion and a bottom portion of the multi-layered stack of material sheets, the bullet-resistive insert assembly being insertable into a pack for resisting bullet penetration through the pack.

2. The bullet-resistive insert assembly of claim 1 wherein the central stack section comprises an anterior-most material layer and a posterior-most material layer, the anterior-most material layer extending in an anterior material plane, the posterior-most material layer extending in a posterior material plane parallel to the anterior material plane, the anterior stack section and the posterior stack sections being obliquely respectively angled at anterior and posterior angled portions relative to the anterior and posterior material planes.

3. The bullet-resistive insert assembly of claim 2 wherein the central stack section comprises a top central stack section and a bottom central stack section, the top central stack section and the bottom central stack section being arcuate in anterior-to-posterior cross-section.

4. The bullet-resistive insert assembly of claim 3 wherein the anterior envelope material layer comprises means for enabling the user to access the multi-layered stack of material sheets.

5. The bullet-resistive insert assembly of claim 3 comprising a handle formation, the handle formation for enhancing a user's ability to carry the bullet-resistive insert assembly.

6. The bullet-resistive insert assembly of claim 3 wherein the exterior stack-covering envelope assembly comprises a bottom assembly edge, a top assembly edge, and opposed lateral assembly edges, the bottom assembly edge extending in a bottom edge plane, the laterally opposed assembly edges extending obliquely relative to the bottom edge plane.

7. The bullet-resistive insert assembly of claim 3 wherein the multi-layered stack of material sheets comprises an outer peripheral stack contour, the outer peripheral stack contour being formed to match and mate with an inner peripheral envelope contour of the exterior stack-covering envelope assembly.

8. The bullet-resistive insert assembly of claim 3 comprising a series of pocket formations, the series of pocket formations being positioned in anterior adjacency to the anterior envelope material layer for enabling a user to store and carry pocket-storable articles.

9. The bullet-resistive insert assembly of claim 3 comprising a peripheral edge binding, the peripheral edge binding covering outer edging of the anterior envelope material layer and the posterior envelope material layer and binding the anterior envelope material layer to the posterior envelope material layer.

10. A projectile-resistive insert assembly, the projectile-resistive insert assembly comprising:

at least one anti-ballistic material sheet, the at least one anti-ballistic material sheet being formed peripherally for receipt in a sheet-covering envelope and comprising an anterior sheet section, a central sheet section, and a posterior sheet section, the anterior sheet section having an anterior sheet length, the central sheet section having a central sheet length, and the posterior sheet section having a posterior sheet length, the central sheet length being relatively greater in magnitude than the anterior sheet length and the posterior sheet length thereby forming step sections at a top portion and a bottom portion of the at least one anti-ballistic material sheet; and an exterior sheet-covering envelope assembly, the exterior sheet-covering envelope assembly comprising an anterior envelope material layer and a posterior envelope material layer, the anterior envelope material layer and the posterior envelope material layer being respectively received in anterior and posterior relation relative to the at least one anti-ballistic material sheet thereby sandwiching the at least one anti-ballistic material sheet between the anterior envelope material layer and the posterior envelope material layer, the anterior envelope material layer being attached to the posterior envelope material layer for enveloping the at least one anti-ballistic material sheet, the projectile-resistive insert assembly being insertable into a pack for resisting projectile penetration through the pack.

11. The projectile-resistive insert assembly of claim 10 wherein the central sheet section comprises an anterior-most material portion and a posterior-most material portion, the anterior-most material portion extending in an anterior material plane, the posterior-most material portion extending in a posterior material plane parallel to the anterior material plane, the anterior sheet section and the posterior sheet section each being obliquely angled relative to the anterior material plane and posterior material plane.

12. The projectile-resistive insert assembly of claim 11 wherein the central sheet section comprises a top central sheet section and a bottom central sheet section, the top central sheet section and the bottom central sheet section being arcuate in anterior-to-posterior cross-section.

13. The projectile-resistive insert assembly of claim 12 wherein a select envelope material layer as selected from the group consisting of the anterior and posterior envelope material layers comprises means for enabling the user to access the at least one anti-ballistic material sheet.

14. The projectile-resistive insert assembly of claim 12 comprising a handle formation, the handle formation attached in adjacency to the posterior envelope material layer for enhancing the user's ability to carry the bullet-resistive insert assembly.

15. The projectile-resistive insert assembly of claim 12 wherein the exterior sheet-covering envelope assembly comprises a bottom assembly edge, a top assembly edge, and opposed lateral assembly edges, the bottom assembly edge extending in a bottom edge plane, the laterally opposed assembly edges extending obliquely relative to the bottom edge plane.

16. The projectile-resistive insert assembly of claim 12 wherein the at least one anti-ballistic material sheet is a multi-layered stack of material sheets.

17. The projectile-resistive insert assembly of claim 16 wherein the multi-layered stack of material sheets comprises an outer peripheral stack contour, the outer peripheral stack contour being formed to mate with an inner peripheral envelope contour of the exterior sheet-covering envelope assembly.

* * * * *